US009574143B2

(12) United States Patent
Bourane et al.

(10) Patent No.: US 9,574,143 B2
(45) Date of Patent: Feb. 21, 2017

(54) DESULFURIZATION AND SULFONE REMOVAL USING A COKER

(75) Inventors: Abdennour Bourane, Ras Tanura (SA); Omer Refa Koseoglu, Dhahran (SA); Stephane Cyrille Kressmann, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 45 days.

(21) Appl. No.: 12/876,781

(22) Filed: Sep. 7, 2010

(65) Prior Publication Data

US 2012/0055845 A1 Mar. 8, 2012

(51) Int. Cl.

| | |
|---|---|
| ***C10G 53/14*** | (2006.01) |
| ***C10G 21/20*** | (2006.01) |
| ***C10G 21/28*** | (2006.01) |
| ***C10B 55/00*** | (2006.01) |
| ***C10B 57/04*** | (2006.01) |
| ***C10G 21/16*** | (2006.01) |

(Continued)

(52) U.S. Cl.

CPC ..... *C10G 53/14* (2013.01); *C10B 55/00* (2013.01); *C10B 57/04* (2013.01); *C10G 21/16* (2013.01); *C10G 21/20* (2013.01); *C10G 21/22* (2013.01); *C10G 21/28* (2013.01); *C10G 27/04* (2013.01); *C10G 27/12* (2013.01); *C10G 53/04* (2013.01); *C10G 2300/202* (2013.01); *C10G 2300/301* (2013.01); *C10G 2300/44* (2013.01)

(58) Field of Classification Search

CPC ..... C10B 55/00; C10B 57/04; C10G 21/16; C10G 21/20; C10G 21/22; C10G 21/28; C10G 2300/202; C10G 2300/301; C10G 2300/44; C10G 27/04; C10G 27/12; C10G 53/04; C10G 53/14

USPC ..... 208/208 R

See application file for complete search history.

(56) References Cited

U.S. PATENT DOCUMENTS

| | | | |
|---|---|---|---|
| 2,380,713 | A | 7/1945 | Wilson |
| 2,704,295 | A | 3/1955 | Gilbert et al. |

(Continued)

FOREIGN PATENT DOCUMENTS

| | | | |
|---|---|---|---|
| WO | 0218518 | A1 | 3/2002 |
| WO | 03014266 | A1 | 2/2003 |

(Continued)

OTHER PUBLICATIONS

Skov, et al., The ULSD Oxidative Desulfurization Option, 2007, Hydrocarbon Engineering.*

(Continued)

*Primary Examiner* — Renee E Robinson
*Assistant Examiner* — Derek Mueller
(74) *Attorney, Agent, or Firm* — Bracewell LLP; Constance Gall Rhebergen; Brad Y. Chin

(57) ABSTRACT

A method and apparatus for upgrading a hydrocarbon feedstock is provided. The method includes the steps of (a) supplying a hydrocarbon feedstock to an oxidation reactor, wherein the hydrocarbon feedstock is oxidized in the presence of a catalyst under conditions sufficient to selectively oxidize sulfur compounds present in the hydrocarbon feedstock; (c) separating the hydrocarbons and the oxidized sulfur compounds by solvent extraction; (d) collecting a residue stream that includes the oxidized sulfur compounds; and (e) supplying the residue stream to a coker to produce coker gases and solid coke.

16 Claims, 3 Drawing Sheets

(51) Int. Cl.

| | |
|---|---|
| ***C10G 21/22*** | (2006.01) |
| ***C10G 27/04*** | (2006.01) |
| ***C10G 27/12*** | (2006.01) |
| ***C10G 53/04*** | (2006.01) |

(56) References Cited

U.S. PATENT DOCUMENTS

| | | | | |
|---|---|---|---|---|
| 2,993,841 | A * | 7/1961 | Sarno | C07C 7/08 203/51 |
| 3,116,231 | A | 12/1963 | Adee | |
| 3,379,638 | A | 4/1968 | Bloomer et al. | |
| 3,472,761 | A | 10/1969 | Cameron | |
| 3,563,884 | A | 2/1971 | Bloomer et al. | |
| 4,036,736 | A | 7/1977 | Ozaki et al. | |
| 4,177,133 | A | 12/1979 | Hayashi et al. | |
| 4,216,074 | A | 8/1980 | Simone | |
| 4,455,219 | A | 6/1984 | Janssen et al. | |
| 4,481,101 | A | 11/1984 | Yan | |
| 5,767,332 | A | 6/1998 | Vollmer et al. | |
| 6,087,544 | A | 7/2000 | Wittenbrink et al. | |
| 6,160,193 | A | 12/2000 | Gore | |
| 6,277,271 | B1 | 8/2001 | Kocal | |
| 7,001,502 | B1 | 2/2006 | Satchwell et al. | |
| 7,232,516 | B2 | 6/2007 | Sughure, II et al. | |
| 7,270,737 | B2 | 9/2007 | Picard et al. | |
| 2005/0150819 | A1 | 7/2005 | Wachs | |
| 2005/0189261 | A1* | 9/2005 | Briot et al. | 208/243 |
| 2007/0051667 | A1 | 3/2007 | Martinie et al. | |
| 2007/0102323 | A1* | 5/2007 | Lee et al. | 208/208 R |
| 2007/0151901 | A1 | 7/2007 | Sain et al. | |
| 2009/0148374 | A1 | 6/2009 | Choi | |

FOREIGN PATENT DOCUMENTS

| | | | |
|---|---|---|---|
| WO | 2006071793 | A1 | 7/2006 |
| WO | 2007103440 | A2 | 9/2007 |

OTHER PUBLICATIONS

Parkash, S., Refining Processes Handbook, 2003, Elevisier, pp. 176-189.*

International Search Report and Written Opinion Issued in PCT Application PCT/US2011/050506, dated Nov. 10, 2011 (10 pages).

* cited by examiner

DESULFURIZATION AND SULFONE REMOVAL USING A COKER

FIELD OF THE INVENTION

This invention relates to a method and apparatus for desulfurizing a hydrocarbon feedstock. More specifically, the present invention relates to a method and apparatus for desulfurization of a hydrocarbon feedstock by oxidative desulfurization of the hydrocarbon feedstock and the subsequent treatment of oxidized sulfur and nitrogen containing species with a coker.

BACKGROUND OF THE INVENTION

Crude oil is the world's main source of hydrocarbons used as fuel and petrochemical feedstock. At the same time, petroleum and petroleum based products are also a major source for air and water pollution today. To address growing concerns surrounding pollution caused by petroleum and petroleum based products, many countries have implemented strict regulations on petroleum products, particularly on petroleum refining operations and the allowable concentrations of specific pollutants in fuels, such as the allowable sulfur and nitrogen content in gasoline fuels. While the exact compositions of natural petroleum or crude oils vary significantly, all crude oils contain some measurable amount of sulfur compounds and most crude oils also contain some measurable amount of nitrogen compounds. In addition, crude oils may also contain oxygen, however oxygen content of most crude is generally low. Sulfur concentrations in crude oils are typically less than about 5 percent by weight, with most crude oils having sulfur concentrations in the range from about 0.5 to about 1.5% by weight. Nitrogen concentrations of most crude oils are usually less than 0.2 percent by weight, but can be as high as 1.6% by weight. In the United States, motor gasoline fuel is regulated to have a maximum total sulfur content of less than 10 ppm sulfur, thus removal of sulfur is a key concern.

Crude oils are refined in oil refineries to produce transportation fuels and petrochemical feedstocks. Typically fuels for transportation are produced by processing and blending of distilled fractions from the crude oil to meet the particular end use specifications. Because most of the crudes generally available today have high concentrations of sulfur, the distilled fractions will require some desulfurization to yield products which meet various performance specifications and/or environmental standards.

The sulfur-containing organic compounds present in crude oils and resulting refined fuels can be a major source of environmental pollution. The sulfur compounds are typically converted to sulfur oxides during the combustion process, which in turn can produce sulfur oxyacids and contribute to particulate emissions.

One method for reducing particulate emissions includes the addition of various oxygenated fuel blending compounds and/or compounds that contain few or no carbon-to-carbon chemical bonds, such as methanol and dimethyl ether. Most of these compounds, however, suffer in that they can have high vapor pressures, be nearly insoluble in diesel fuel, and/or have poor ignition quality, as indicated by their cetane numbers.

Diesel fuels that have been treated by chemical hydrotreating and/or hydrogenation to reduce the content of sulfur and aromatic compounds frequently have a reduced fuel lubricity, which in turn can cause excessive wear of fuel pumps, injectors and other moving parts that come in contact with the fuel under high pressures.

For example, middle distillates (a distillate fraction that nominally boils in the range of about 180-370° C.) can be used directly as a fuel, or alternatively can be used as a blending component of fuel for use in compression ignition internal combustion engines (i.e., diesel engines). The middle distillate fraction typically include between about 1 and 3% by weight sulfur, which is greater than allowable sulfur concentration of middle distillate fractions, which, since 1993, have been reduced in Europe and United States to between about 5-50 part per million weight (ppmw) levels from the 3000 ppmw level.

Conventional techniques currently employed for the removal of sulfur and nitrogen compounds typically still require the subsequent recovery and/or disposal of the sulfur and nitrogen containing compounds that are removed from the hydrocarbons. In order to comply with the increasingly stringent regulations for ultra-low sulfur content fuels, refiners must make fuels having even lower sulfur levels at the refinery gate so that they can meet the strict specifications after blending.

Low pressure conventional hydrodesulfurization (HDS) processes can be used to remove a major portion of the sulfur from petroleum distillates for the eventual blending of refinery transportation fuels. These desulfurization units, however, are not very efficient at removing sulfur from compounds at mild conditions (i.e., up to about 30 bar pressure), and when the sulfur atom is sterically hindered as is the case in multi-ring aromatic sulfur compounds. This is particularly true where the sulfur heteroatom is hindered by two alkyl groups (e.g., 4,6-dimethyldibenzothiophene). Because of the difficulty in the removal of sulfur from sterically hindered compounds, dibenzothiophenes predominate at low sulfur levels such as 50 to 100 ppmw. Severe operating conditions (e.g., high hydrogen partial pressure, high temperature, high catalyst volume) typically must be utilized in order to remove the sulfur from these refractory sulfur compounds. Increasing the hydrogen partial pressure can only be achieved by increasing the recycle gas purity, or new grassroots units must be designed, which can be a very costly option. The use of severe operating conditions typically results in decreased yield, reduced catalyst life cycle, and product quality deterioration (e.g., color), and therefore are typically sought to be avoided.

Conventional methods for petroleum upgrading, specifically for the removal of sulfur and/or nitrogen containing compounds, however, suffer from various limitations and drawbacks. For example, hydrogenative methods typically require large amounts of hydrogen gas to be supplied from an external source to attain desired upgrading and conversion. These methods can also suffer from premature or rapid deactivation of catalyst, as is typically the case during hydrotreatment of a heavy feedstock and/or hydrotreatment under harsh conditions, thus requiring regeneration of the catalyst and/or addition of new catalyst, which in turn can lead to process unit downtime. Thermal methods, on the other hand, frequently suffer from the production of large amounts of coke as a byproduct and a limited ability to remove impurities, such as, sulfur and nitrogen. Additionally, thermal methods require specialized equipment suitable for severe conditions (high temperature and high pressure), and require the input of significant energy, thereby resulting in increased complexity and cost, Thus, there exists a need to provide that include methods for the upgrading of hydrocarbon feedstocks, such as by removing sulfur and nitrogen from the hydrocarbon feedstocks, and which also include steps processes for the desulfurization and denitrogenation of hydrocarbon feedstocks that use low severity conditions that can also provide means for the recovery and/or disposal of sulfur and nitrogen containing compounds.

SUMMARY

The current invention provides a method and apparatus for the upgrading of a hydrocarbon feedstock that removes a major portion of the sulfur and nitrogen present and in turn utilizes these compounds in an associated process.

In one aspect, a method of upgrading a hydrocarbon feedstock. The method includes the steps of supplying the hydrocarbon feedstock to an oxidation reactor, wherein the hydrocarbon feedstock includes sulfur containing compounds. The hydrocarbon feedstock is contacted with an oxidant in the presence of a catalyst in the oxidation reactor under conditions sufficient to selectively oxidize sulfur compounds present in the hydrocarbon feedstock and to produce a hydrocarbon stream that includes hydrocarbons and oxidized sulfur containing compounds. The method includes supplying the hydrocarbon stream to an extraction vessel and separating the hydrocarbon stream into an extracted hydrocarbon stream and a mixed stream by extracting the hydrocarbon stream with a polar solvent, wherein the mixed stream includes the polar solvent and the oxidized sulfur containing compounds, and wherein the extracted hydrocarbon stream has a lower concentration of the sulfur containing compounds than the hydrocarbon feedstock. The method includes separating the mixed stream into a first recovered polar solvent stream and a first residue stream; and supplying the first residue stream to a coker to produce coker vapors and solid coke.

In certain embodiments, the hydrocarbon feedstock further includes nitrogen containing compounds, such that the step of contacting the hydrocarbon feedstock with the oxidant in the presence the catalyst oxidizes at least a portion of the nitrogen containing compounds, and wherein the residue stream supplied to the coker includes the oxidized nitrogen containing compounds. In certain other embodiments, the method further includes the step of supplying the extracted hydrocarbon stream to an adsorption column, wherein the adsorption column is charged with an adsorbent suitable for the removal of oxidized compounds present in the extracted hydrocarbon stream, and the adsorption column produces a high purity hydrocarbon product stream and a second residue stream, the second residue stream containing a portion of the oxidized compounds.

In another aspect, a method for upgrading a hydrocarbon feedstock that includes sulfur containing compounds is provided. The method includes the steps of supplying the hydrocarbon feedstock to an oxidation reactor wherein the hydrocarbon feedstock is contacted with an oxidant and a catalyst to oxidize at least a portion of the sulfur containing compounds in the hydrocarbon feedstock and produce an intermediate product stream comprising hydrocarbons and oxidized sulfur containing compounds. The method further includes the step of supplying the intermediate product stream that includes hydrocarbons and oxidized sulfur containing compounds to an extraction vessel wherein the intermediate product stream is contacted with a polar solvent, wherein said polar solvent selectively extracts oxidized sulfur containing compounds from the intermediate product stream, to produce a first hydrocarbon product stream and a mixed stream that includes the polar solvent and the extracted oxidized sulfur containing compounds. The mixed stream is separated by distillation into a recovered solvent stream comprising a major portion of the polar solvent, and a residue stream comprising the oxidized sulfur containing compounds. The method further includes supplying the residue stream to a coker to produce a recovered hydrocarbon product stream comprising condensed coker vapors and gas oil and solid coke, wherein the coker includes a coker furnace and a coker drum, and wherein the coker furnace is operated at a temperature of at least about 400° C. and the coker drum is operated at a temperature of at least about 425° C. and a pressure in the range of between about 1 and 50 kg/cm$^2$. The method further includes supplying at least a portion of the recovered solvent stream to the extraction vessel wherein at least a portion of the recovered solvent stream is combined with the polar solvent.

DETAILED DESCRIPTION OF THE INVENTION

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, relating to the claimed invention.

The present invention addresses problems associated with prior art methods upgrading a hydrocarbon feedstock, particularly methods for the desulfurization and denitrogenation of hydrocarbon feedstocks, and the subsequent recovery, removal, and/or disposal of sulfur and nitrogen containing compounds. In certain embodiments, the present invention finds use of various sulfur and nitrogen containing compounds that are removed from the hydrocarbon feedstock. Thus, in one aspect, the present invention provides a method for the removal of sulfur from a hydrocarbon feedstock and the subsequent supply of the oxidized sulfur species to a delayed coker to produce gas oil and coke.

As used herein, the terms "upgrading" or "upgraded", with respect to petroleum or hydrocarbons refers to a petroleum or hydrocarbon product that is lighter (i.e., has fewer carbon atoms, such as methane, ethane, and propane . . . ), and/or has a higher API gravity, higher middle distillate yield, lower sulfur content, lower nitrogen content, or lower metal content, than does the original petroleum or hydrocarbon feedstock.

Figure 1:
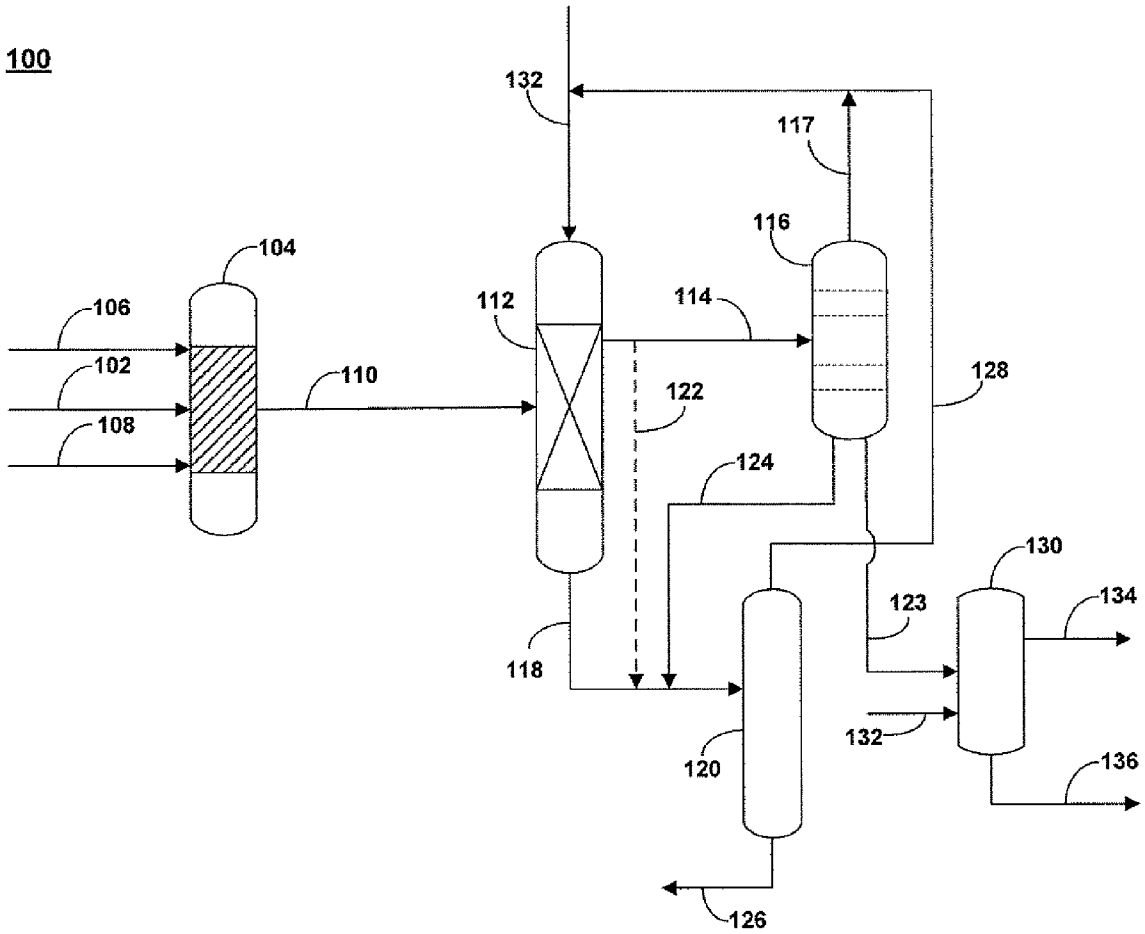
FIG. 1 provides a schematic diagram of one embodiment of the method of upgrading a hydrocarbon feedstock according to the present invention.

FIG. 1 provides one embodiment of the present invention for the upgrading of hydrocarbons. Hydrocarbon upgrading system 100 includes oxidation reactor 104, extraction vessel 112, solvent regeneration column 116, stripper 120, and coker 130.

In one aspect, the present invention provides a method for the upgrading of a hydrocarbon feedstock, particularly a hydrocarbon feedstock that includes sulfur and/or nitrogen containing compounds. The method includes supplying hydrocarbon feedstock 102 to oxidation reactor 104, where the hydrocarbon feedstock is contacted with an oxidant and a catalyst. Sulfur and nitrogen containing compounds are preferably oxidized upon contacting the oxidant and catalyst. The oxidant can be supplied to oxidation reactor 104 via oxidant feed line 106 and fresh catalyst can be supplied to the reactor via catalyst feed line 108, Hydrocarbon feedstock 102 can be any petroleum based hydrocarbon, and can include various impurities, such as elemental sulfur, and/or compounds that include sulfur and/or nitrogen. In certain embodiments, hydrocarbon feedstock 102 can be a diesel oil having a boiling point between about 150° C. and 400° C. Alternatively, hydrocarbon feedstock 102 can have a boiling point up to about 450° C., alternatively up to about 500° C. In certain embodiments, hydrocarbon feedstock 102 can be a diesel oil having a boiling point between about 150° C. and 370° C. In certain embodiments, hydrocarbon feedstock 102 can be a vacuum gas oil having a boiling point between about 370° C. and 520° C. Alternatively, hydrocarbon feedstock 102 can have a boiling point up to about 450° C., alternatively up to about 500° C. Alternatively, hydrocarbon feedstock 102 can have a boiling point between about 100° C. and 500° C. Optionally, hydrocarbon feedstock 102 can have a boiling point up to about 600° C., alternatively up to about 700° C., or, in certain embodiments, greater than about 700° C. In certain embodiments, hydrocarbon feedstock 102 can include heavy hydrocarbons. As used herein, heavy hydrocarbons refers to hydrocarbons having a boiling point of greater than about 360° C., and can include aromatic hydrocarbons, as well as alkanes, alkenes, and naphthenes.

Generally, in certain embodiments, hydrocarbon feedstock 102 can be selected from whole range crude oil, topped crude oil, product streams from oil refineries, product streams from refinery steam cracking processes, liquefied coals, liquid products recovered from oil or tar sand, bitumen, oil shale, asphaltene, and the like, and mixtures thereof.

Exemplary sulfur compounds present in hydrocarbon feedstock 102 can include sulfides, disulfides, and mercaptans, as well as aromatic molecules such as thiophenes, benzothiophenes, dibenzothiophenes, and alkyl dibenzothiophenes, such as 4,6-dimethyl-dibenzothiophene. Aromatic compounds are typically more abundant in higher boiling fractions, than is typically found in the lower boiling fractions.

Exemplary nitrogen containing compounds present in hydrocarbon feedstock 102 can include basic and neutral nitrogen compounds, including indoles, carbazoles, anilines, quinolines, acridines, and the like.

Oxidation reactor 104 can be operated at mild conditions, relative to the conditions typically used in conventional hydrodesulfurization processes for diesel type feedstocks. More specifically, in certain embodiments, oxidation reactor 104 can be maintained at a temperature of between about 20° C. and about 150° C., alternatively between about 30° C. and about 150° C., alternatively between about 30° C. and about 90° C., or between about 90° C. and about 150° C. In certain embodiments, the temperature is preferably between about 30° C. and about 75° C., more preferably between about 45° C. and 60° C. The operating pressure of oxidation reactor 104 can be between about 1 and 80 bars, alternatively between about 1 and 30 bars, alternatively between about 1 and 15 bars, and preferably between about 2 and 3 bars. The residence time of the hydrocarbon feedstock within oxidation rector 102 can be between about 1 and 180 minutes, alternatively between about 15 and 180 minutes, alternatively between about 15 and 90 minutes, alternatively between about 5 and 60 minutes, alternatively between about 60 and 120 minutes, alternatively between about 120 and 180 minutes, and is preferably for a sufficient amount of time for the oxidation of any sulfur or nitrogen compounds present in the hydrocarbon feedstock. In one embodiment, the residence time of the hydrocarbon feedstock within oxidation rector 104 is between about 15 and 45 minutes. For comparison, conventional hydrodesulfurization of diesel type feedstocks are typically conducted under harsher conditions, for example, at temperatures of between about 330 and 380° C., pressures of between about 50 and 80 $Kg/cm^2$, and LHSV of between about 0.5 and 2 $h^{-1}$.

Oxidation reactor 104 can be any reactor suitably configured to ensure sufficient contacting between hydrocarbon feedstock 102 and the oxidant, in the presence of a catalyst, for the oxidation of the sulfur and nitrogen containing compounds. Suitable reactors for oxidation reactor 104 can include batch reactors, fixed bed reactors, ebullated bed reactors, lifted reactors, fluidized bed reactors, slurry bed reactors, and the like. Sulfur and nitrogen compounds present in hydrocarbon feedstock 102 are oxidized in oxidation reactor 104 to sulfones, sulfoxides, and oxidized nitrogen compounds, which can be subsequently removed by extraction and/or adsorption. Exemplary oxidized nitrogen compounds can include pyridine and pyrrole-based compounds or pyridine-difuran compounds. Frequently, during oxidation, the nitrogen atom itself is not oxidized, but rather the compound is oxidized to a compound that is easy to separate from the remaining compounds.

The oxidant is supplied to oxidation reactor 104 via oxidant feed stream 106. Suitable oxidants can include air, oxygen, ozone, hydrogen peroxide, organic peroxides, hydroperoxides, organic peracids, peroxo acids, oxides of nitrogen, such as nitrous oxide, and the like, and combinations thereof. Exemplary peroxides can be selected from hydrogen peroxide, and the like. Exemplary hydroperoxides can be selected from t-butyl hydroperoxide, and the like. Exemplary organic peracids can be selected from peracetic acid, and the like.

In certain embodiments, such as hydrocarbon feedstocks having a greater concentration of sulfur than nitrogen, the mole ratio of oxidant to sulfur present in the hydrocarbon feedstock can be from about 1:1 to 50:1, preferably between about 2:1 and 20:1, more preferably between about 4:1 and 10:1.

In certain other embodiments, such as hydrocarbon feedstocks having a greater concentration of nitrogen than sulfur, for example, certain South American crude oils, certain African crude oils, certain Russian crude oils, certain Chinese crude oils, and certain intermediate refinery streams like coker, thermal cracking, visbreaking, FCC cycle oils, and the like, the mole ratio of oxidant to nitrogen present in the hydrocarbon feedstock can be from about 1:1 to 50:1, preferably between about 2:1 and 20:1, more preferably between about 4:1 and 10:1.

The catalyst can be supplied to oxidation reactor 104 via catalyst feed stream 108. The catalyst can include at least one metal oxide having the chemical formula $M_xO_y$, wherein M is a metal selected from groups IVB, VB, or VIB of the periodic table. Exemplary metals can include titanium, vanadium, chromium, molybdenum, and tungsten. Certain preferred metals include oxides of molybdenum and tungsten.

In certain embodiments, such as the use of aqueous oxidants, spent catalyst can be removed from the system with the aqueous phase, after the oxidation vessel.

The ratio of catalyst to oil is between about 0.1% by weight and about 10% by weight, preferably between about 0.5% by weight and about 5% by weight. In certain embodiments, the ratio is between about 0.5% by weight and about 2.5% by weight. Alternatively, the ratio is between about 2.5% by weight and about 5% by weight.

Catalyst present in oxidation reactor 104 can increase the rate of oxidation of the various sulfur and nitrogen containing compounds in hydrocarbon feedstock 102, thereby achieving completion of the reaction and oxidation of sulfur and nitrogen containing compounds in a shorter amount of time, reducing the amount of oxidant necessary to achieve oxidation of the sulfur and nitrogen containing compounds. In certain embodiments, the catalyst may have increased selectivity toward the oxidation of sulfur containing and/or nitrogen containing species. In preferred embodiments, the catalyst is selective to the minimization of oxidation of aromatic hydrocarbons.

Oxidation reactor 104 produces oxidized sulfur and oxidized nitrogen containing hydrocarbon stream 110, which can include oxidized sulfur and oxidized nitrogen containing hydrocarbon species. The oxidation by-products vary based upon what the original oxidant is. For example, in embodiments wherein the oxidant is hydrogen peroxide, water is formed as a by-product of the oxidation reaction. In embodiments wherein the oxidant is an organic peroxide, alcohol is formed as a by-product of the oxidation reaction. By-products are typically removed during the extraction and solvent recovery steps.

Oxidized sulfur and oxidized nitrogen containing hydrocarbon stream 110 is supplied to extraction vessel 112 where the oxidized sulfur and oxidized nitrogen containing hydrocarbon species are contacted with extraction solvent stream 132. The extraction solvent can be a polar solvent, and in certain embodiments, can have a Hildebrandt solubility value of greater than about 19. In certain embodiments, when selecting the particular polar solvent for use in extracting oxidized sulfur and nitrogen containing hydrocarbon species, selection can be based upon, in part, solvent density, boiling point, freezing point, viscosity, and surface tension. Exemplary polar solvents suitable for use in the extraction step can include acetone (Hildebrand value of 19.7), carbon disulfide (20.5), pyridine (21.7), dimethyl sulfoxide (DMSO) (26.4), n-propanol (24.9), ethanol (26.2), n-butyl alcohol (28.7), propylene glycol (30.7), ethylene glycol (34.9), dimethylformamide (DMF) (24.7), acetonitrile (30), methanol (29.7), and the like. In certain embodiments, acetonitrile and methanol, due to their low cost, volatility, and polarity, are preferred. In certain embodiments, solvents that include sulfur, nitrogen, or phosphorous, preferably have a relatively high volatility to ensure adequate stripping of the solvent from the hydrocarbon feedstock.

In preferred embodiments, the extraction solvent is non-acidic and the extraction step is conducted in an acid-free environment. The use of acids is typically avoided due to the general corrosive nature of acids, and the requirement that all equipment be specifically designed for a corrosive environment. In addition, acids, such as acetic acid, can present difficulties in separation due to the formation of emulsions.

Extraction vessel 112 can be operated at a temperature of between about 20° C. and 60° C., preferably between about 25° C. and 45° C., even more preferably between about 25° C. and 35° C. Extraction vessel 112 can operate at a pressure of between about 1 and 10 bars, preferably between about 1 and 5 bars, more preferably between about 1 and 2 bars. In certain embodiments, extraction vessel 112 operates at a pressure of between about 2 and 6 bars.

The ratio of the extraction solvent to hydrocarbon feedstock can be between about 1:3 and 3:1, preferably between about 1:2 and 2:1, more preferably about 1:1. Contact time between the extraction solvent and the oxidized sulfur and oxidized nitrogen containing hydrocarbon stream 110 can be between about 1 second and 60 minutes, preferably between about 1 second and about 10 minutes. In certain preferred embodiments, the contact time between the extraction solvent and oxidized sulfur and oxidized nitrogen containing hydrocarbon stream 110 is less than about 15 minutes. In certain embodiments, extraction vessel 112 can include various means for increasing the contact time between the extraction solvent and oxidized sulfur and oxidized nitrogen containing hydrocarbon stream 110, or for increasing the degree of mixing of the two solvents. Means for mixing can include mechanical stirrers or agitators, trays, or like means.

The extraction vessel produces mixed stream 114 that can include extraction solvent, oxidized species (eg., the oxidized sulfur and nitrogen containing hydrocarbon species that were originally present in hydrocarbon feedstock 102), and the hydrocarbon feedstock, and extracted hydrocarbon stream 118, which can include the hydrocarbon feedstock having a reduced concentration of sulfur and nitrogen containing hydrocarbons, relative to hydrocarbon feedstock 102. Typically, the hydrocarbon feedstock is only present in mixed stream 114 in trace amounts.

Mixed stream 114 can be supplied to solvent regeneration column 116 where extraction solvent can be recovered as first recovered solvent stream 117 and separated from first residue stream 123, which includes oxidized sulfur and nitrogen containing hydrocarbon compounds. Optionally, mixed stream 114 can be separated in solvent regeneration column 116 into a recovered hydrocarbon stream 124, which can include hydrocarbons present in mixed stream 114 from hydrocarbon feedstock 102. Solvent regeneration column 116 can be a distillation column that is configured to separate mixed stream 114 into first recovered solvent stream 117, first residue stream 123, and recovered hydrocarbon stream 124.

Extracted hydrocarbon stream 118 can be supplied to stripper 120, which can be a distillation column or like vessel designed to separate a hydrocarbon product stream from residual extraction solvent. In certain embodiments, a portion of mixed stream 114 can optionally be supplied to stripper 120 via line 122, and where it can be combined with extracted hydrocarbon stream 118. In certain embodiments, solvent regeneration column 116 can produce recovered hydrocarbon stream 124, which can be supplied to stripper 120, where the recovered hydrocarbon stream can optionally be contacted with extracted hydrocarbon stream 118 and/or a portion of mixed stream 114, which can be supplied to the stripper via line 122.

Stripper 120 separates the various streams supplied thereto into stripped oil stream 126, which includes hydrocarbons present in hydrocarbon feedstock 102 and has a reduced sulfur and/or nitrogen content relative the hydrocarbon feedstock, and second recovered solvent stream 128.

In certain embodiments, first recovered solvent stream 117 can be combined with second recovered solvent stream 128 and recycled to extraction vessel 112. Optionally, make-up solvent stream 132, which can include fresh solvent, can be combined with first recovered solvent stream 117 and/or second recovered solvent stream 128 and supplied to extraction vessel 112.

First residue stream 123, which includes oxidized sulfur and nitrogen containing compounds, and can also include some hydrocarbonaceous material, can be supplied to coker 130 where the first residue stream can be converted to recover hydrocarbons. Coker 130 can be a delayed coker, fluid coker, flexicoker, or like device. In certain preferred embodiments, coker 130 can be a delayed coker. Delayed coker 130 can include at least a coker fractionator, a coker furnace, and at least one coke drum. In preferred embodiments, coker 130 is supplied with additional feedstock from alternate processes in addition to first residue stream 123.

In a basic delayed coking process that may be utilized in certain embodiments of the present invention, the feed to the coker can include oxidized sulfur and/or oxidized nitrogen compounds, as well as possibly also including trace amounts of the extraction solvent and/or hydrocarbon feedstock, and can be introduced into the lower part of a coker fractionator. Materials supplied to the coker fractionator, including the oxidized sulfur and/or nitrogen containing compounds, can also include fractionator bottoms that can include heavy recycle material. Optionally, second hydrocarbon feedstock 132, which can include residual oils from a vacuum distillation column or atmospheric distillation column, can be supplied to coker 130.

Material supplied to the coker is heated to coking temperature in the coker furnace to produce a heated coker feedstock. In certain embodiments, the coker furnace can be operated at a temperature greater than about 400° C., alternatively greater than about 450° C., alternatively greater than about 475° C. In certain embodiments, the coker furnace can be operated at a temperature between about 475° C. and 525° C.

The heated coker feedstock can then be supplied to a coke drum that is maintained at a temperature and pressure sufficient for coking conditions to decompose or crack the heated coker feedstock to form coke and volatile component stream 134, which may include low molecular weight hydrocarbon gases. In certain embodiments, volatile component stream 134 can be collected and combined with stripped oil stream 126. In certain embodiments, volatile component stream 134 can be separately collected and utilized in an alternate process.

The coke drum can be operated at a temperature of greater than about 425° C., alternatively between about 425° C. and 650° C., alternatively between about 450° C. and 510° C., alternatively between about 470° C. and 500° C. In certain embodiments, the coker drum is operated at a temperature of at least 500° C., alternatively at a temperature of at least 525° C.

Operating pressures within the coker drum can be in the range of about 1-50 kg/cm$^2$, alternatively in the range of about 5-40 kg/cm$^2$, or alternatively in the range of about 10-30 kg/cm$^2$. In certain embodiments, the coker is operated at a pressure in the range of about 10-25 kg/cm$^2$. In alternate embodiments, the coker is operated at a pressure in the range of about 25-40 kg/cm$^2$. In an alternate embodiment, the coker is operated at a pressure in the range of between about 1-10 kg/cm$^2$ , preferably between about 1-3 kg/cm$^2$.

Volatile components (coker vapor) collected overhead as a volatile component stream 134 from the coker drum can be recovered from the drum and returned to the coker fractionator. Light and heavy gas oil fractions from the coker fractionator can be supplied to a flash zone of the fractionator, where the heavy gas oil can be used to condense the heaviest components from the coker vapors. The heaviest fraction of the coke drum vapors can also be condensed by other techniques, such as with a heat exchange, but in certain preferred embodiments, incoming coke drum vapors are preferably condensed with a light or heavy gas oil in the coker fractionator. In certain embodiments, a conventional heavy fraction recycle to the coker fractionator can include hydrocarbons condensed from the coke drum vapors and unflashed heavy gas oil. During the continuous process of feed, coke accumulates in the coker drum such that when the coke drum is full of coke, the feed can be switched to another drum, and the full drum is cooled and emptied by conventional methods to produce coke stream 136, thereby allowing the process to operate continuously.

In certain embodiments, the coker includes two or more coker drums, which can be operated in an alternating fashion, as described above. For example, a feedstock can be supplied to a first coker drum, and the feedstock can be heated in the first coker drum to produce coker vapor and solid coke. After a predetermined amount of solid coke has accumulated within the first coker drum, the feedstock to the first coker drum can be stopped and can be supplied to a second coker drum, which is operated in a similar manner to the first drum, until a predetermined amount of coke has accumulated within the second coker drum. During the operation of the second coker drum, the feed and heating supply to the first coker drum can be stopped, and coke within the first coker drum can be removed, As noted above, by alternating between use of the first and second coker drums, it is possible to remove a drum from service, while not stopping the overall coking process. When a coker drum is removed from service, coke therein can be removed by conventional means to produce coke product stream 136.

Figure 2:
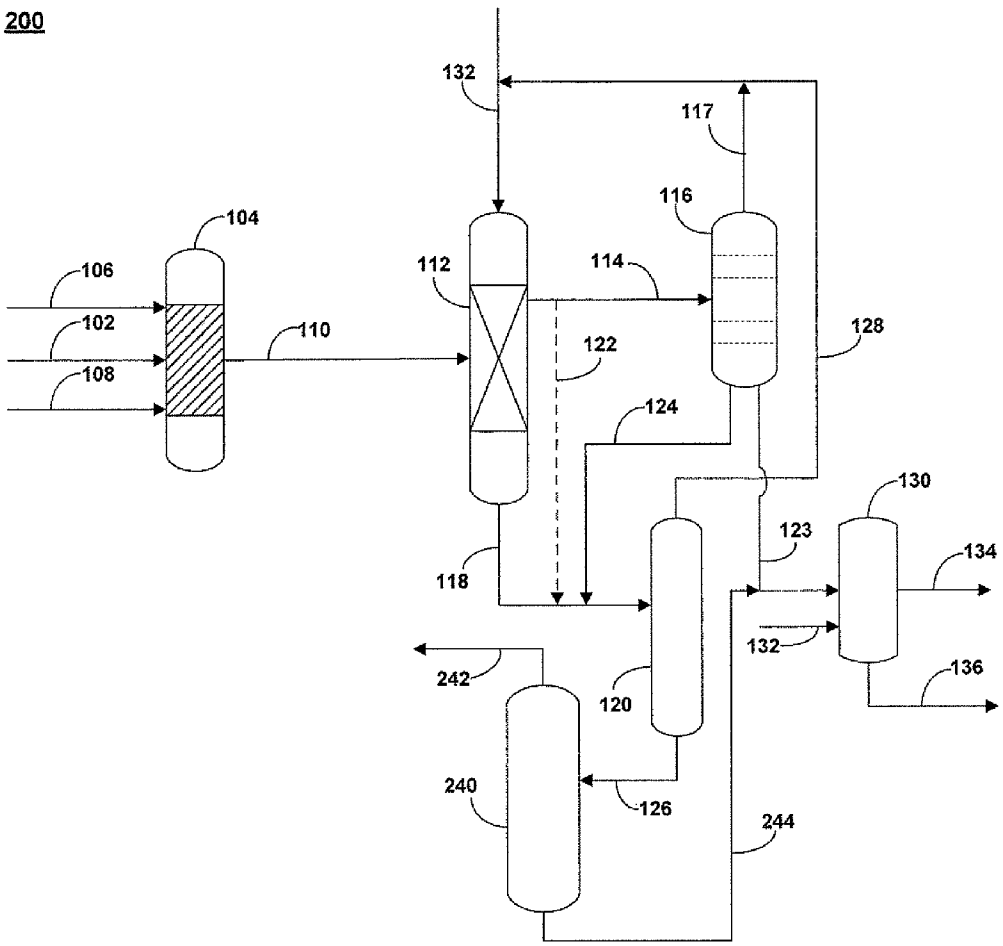
FIG. 2 provides a schematic diagram of one embodiment of the method of upgrading a hydrocarbon feedstock according to the present invention.

Referring to a system 200 as shown in FIG. 2, a second embodiment if provided wherein stripped oil stream 126 can be supplied to an adsorption column 240, where the stream can be contacted with one or more adsorbent designed to remove one or more of various impurities, such as sulfur containing compounds, oxidized sulfur compounds, nitrogen containing compounds, oxidized nitrogen compounds, and metals remaining in the hydrocarbon product stream after oxidation and solvent extraction steps, to produce hydrocarbon product stream 242 and adsorption unit residue stream 244.

Exemplary adsorbents can include activated carbon, silica gel, alumina, natural clays, and other inorganic adsorbents. In certain preferred embodiments, the adsorbent can include polar polymers that have been applied to or that coat various high surface area support materials, such as silica gel, alumina, and activated carbon. Exemplary polar polymers for use in coating various support materials can include polysulfones, polyacrylonitrile, polystyrene, polyester terephthalate, polyurethane, other like polymer species that exhibit an affinity for oxidized sulfur species, and combinations thereof.

Adsorption column 240 can be operated at a temperature of between about 20° C. and 60° C., preferably between about 25° C. and 40° C., even more preferably between about 25° C. and 35° C. In certain embodiments, the adsorption column can be operated at a temperature of between about 10° C. and 40° C., alternatively between about 35° C. and 75° C. In certain embodiments, the adsorption column can be operated at temperatures of greater than about 20° C., or alternatively at temperatures less than about 60° C. The adsorption column can be operated at a pressure of up to about 15 bars, preferably up to about 10 bars, even more preferably between about 1 and 2 bars. In certain embodiments, the adsorption column can be operated at a pressure of between about 2 and 5 bars. In an exemplary embodiment, the adsorption column can be operated at a temperature of between about 25° C. and 35° C. and a pressure of between about 1 and 2 bars.

Adsorption column 240 separates the feed into hydrocarbon product stream 242 having very low sulfur and very low nitrogen content and adsorption unit residue stream 244. Adsorption unit residue stream 244 can include oxidized sulfur and oxidized nitrogen compounds, and can optionally be combined with first residue stream 123 and supplied to coker 130 and processed as noted above.

Figure 3:
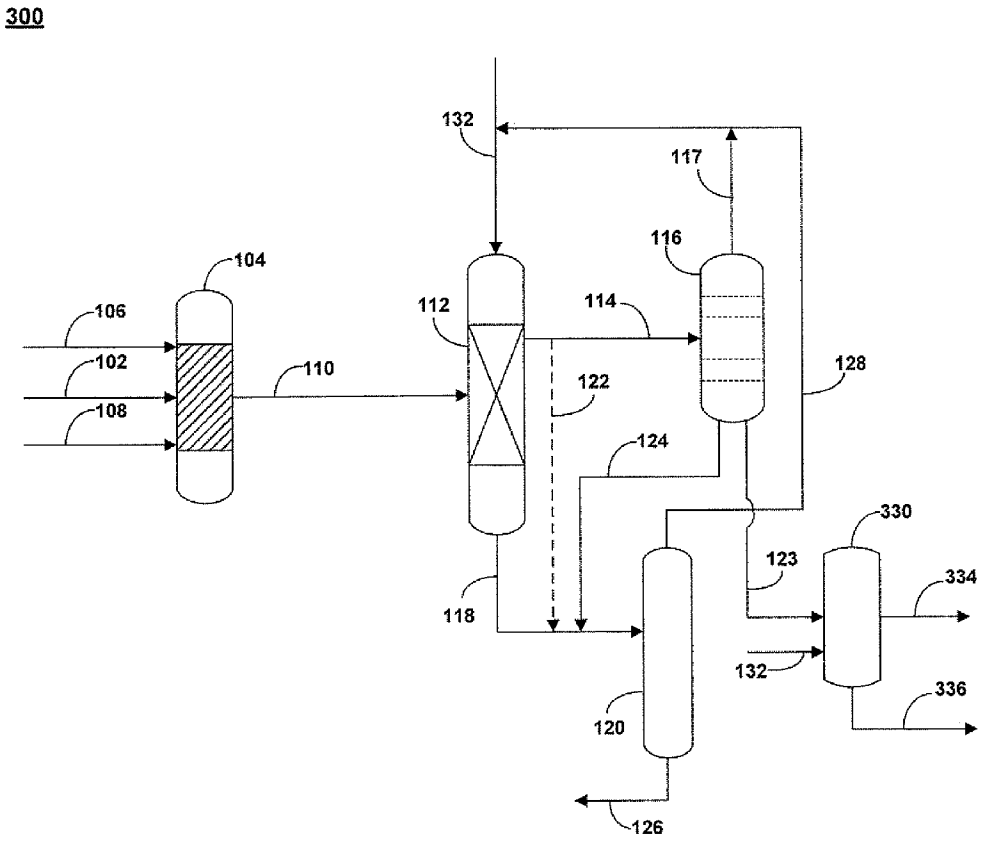
FIG. 3 provides a schematic diagram of one embodiment of the method of upgrading a hydrocarbon feedstock according to the present invention.

Referring to a system 300 as shown in FIG. 3, a second embodiment of the present invention is provided wherein first residue stream 123, which includes oxidized sulfur containing compounds and/or oxidized nitrogen containing compounds, is supplied to thermal cracking unit 330. Thermal cracking unit 330 includes a series of tubes which are heated to partially convert the feedstock to lower boiling fractions of hydrocarbons 334. Reside can be collected from thermal cracking unit 330 via line 336. In certain embodiments, thermal cracking unit 330 can be supplied with hydrocarbons from an alternate source via line 132. In certain embodiments, effluent from thermal cracking unit 330, which consists of lower boiling fractions of hydrocarbons, can be routed to the flash zone of stripper 120 (Not shown).

EXAMPLE

In one example, a hydrotreated straight run diesel stream 102 containing 500 ppmw of elemental sulfur 0.28 W % of organic sulfur density of 0.85 Kg/lt was oxidatively desulfurized. The oxidized and extracted sulfur compounds are mixed with a residue stream feed stream 136, properties of which are shown in Table 1, and the combined stream was supplied to the coker.

TABLE 1

| Property | Value |
|---|---|
| API Gravity | 4.6 |
| Specific Gravity | 1.04 |
| Sulfur Content, wt. % | 5.42 |
| Nitrogen Content, wt. % | 0.437 |
| Oxygen Content, wt. % | 0.1 |
| CCR, wt. % | 24.6 |
| C5 - Asphaltenes, wt. % | 23.5 |
| Nickel, ppmw | 44 |
| Vanadium, ppmw | 162 |

The reaction conditions were as follows: the mole ratio of hydrogen peroxide to sulfur was 4:1. The catalyst was a Molybdenum (VI) based catalyst. The reaction time was 30 minutes. The temperature was maintained at about 80° C., and the pressure was maintained at about 1 Kg/cm2. The coker was operated at a temperature of about 482° C. and a pressure of about 1 Kg/cm$^2$. Material balances for the oxidation step are provided in Table 2.

TABLE 2

| | Stream No. | | | |
|---|---|---|---|---|
| Component | 102 Kg/h | 106 Kg/h | 108 Kg/h | 110 Kg/h |
| Water | 0.7 | 3.85 | 3.85 | 0.48 |
| Diesel | 1099.93 | | | 1094 |
| Acetic Acid | | 150 | 150 | 95 |
| Hydrogen Peroxide | | 1.65 | 1.65 | |
| Solid Catalyst | | 1.5 | 1.5 | |
| Total | 1100 | 157 | 157 | 1190 |

Material balances for the extraction step for the exemplary embodiment are provided in Table 3.

TABLE 3

| | Stream No. | | | | | |
|---|---|---|---|---|---|---|
| Component | 110 Kg/h | 132 Kg/h | 114 Kg/h | 118 Kg/h | 117 Kg/h | 123 Kg/h |
| Water | 2.38 | | 0.42 | 0.6 | 0.42 | |
| MeOH | | 1190 | 1182 | 8 | 1182 | |
| Diesel | 5472.63 | | | 967 | | |
| Diesel Reject | | | 102.6 | | | 102.6 |
| Acetic Acid | | | 95 | | 95 | |
| Solid Catalyst | | | | | | |
| Total | 5950 | 1190 | 1380.02 | 975.06 | 1277.42 | 102.6 |

Material balances for the coker step for the exemplary embodiment are provided in Table 4.

TABLE 4

| | Stream No. | | | |
|---|---|---|---|---|
| Component | 123 Kg/h | 132 Kg/h | 334 Kg/h | 336 Kg/h |
| Vacuum Residue | | 1000 | | |
| Sulfones | 102.6 | | | |
| Light Coker Products | | | 668.62 | |
| Coke | | | | 433.98 |
| Total | 102.6 | 1000 | 668.62 | 433.98 |

Yields for processing the feed with a coker are shown in Table 5.

TABLE 53

| Coker Yields. | | | | | |
|---|---|---|---|---|---|
| Coker Yield | Percent Composition | MBP | SG | S, wt. % | N, ppm |
| Coke | 39.36 | | | 7.96 | 5813 |
| Gas | 11.342 | | | | |
| $H_2S$ | 1.704 | | | | |
| C1-C4 | 9.639 | | | | |
| C1 | 3.747 | | | | |
| C2D | 0.018 | | | | |
| C2 | 2.079 | | | | |
| C3D | 0.568 | | | | |
| C3 | 1.572 | | | | |
| C4 | 0.586 | | | | |
| i-C4 | 0.253 | | | | |
| n-C4 | 0.657 | | | | |
| $H_2$ | 0.120 | | | | |
| $CO_2$ | 0.039 | | | | |
| Naphtha (BP 36-180° C.) | 19.728 | 108 | 0.74 | 1.78 | 67 |
| Light Cycle Gas Oil (BP 180-350° C.) | 16.892 | 265 | 0.88 | 3.69 | 1440 |
| Heavy Cycle Gas Oil (BP 350-540° C.) | 12.677 | 445 | 0.98 | 5.98 | 2833 |
| Total | 100 | | | 5.42 | 2082 |

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made herein.

That which is claimed is:

1. A method of upgrading a hydrocarbon feedstock, the method comprising the steps of:

supplying the hydrocarbon feedstock to an oxidation reactor, the hydrocarbon feedstock comprising sulfur containing compounds;

contacting the hydrocarbon feedstock with an oxidant in the presence of a catalyst in the oxidation reactor under conditions sufficient to selectively oxidize sulfur compounds present in the hydrocarbon feedstock to produce a hydrocarbon stream that comprises hydrocarbons and oxidized sulfur containing compounds;

supplying the hydrocarbon stream to an extraction vessel and separating the hydrocarbon stream into an extracted hydrocarbon stream and a mixed stream by extracting the hydrocarbon stream with a non-acidic polar organic solvent, the non-acidic polar organic solvent being dimethylformamide, wherein the mixed stream comprising the non-acidic polar organic solvent and the oxidized sulfur containing compounds and wherein the extracted hydrocarbon stream has a lower concentration of the sulfur containing compounds than the hydrocarbon feedstock;

separating the mixed stream using a distillation column into a first recovered non-acidic polar organic solvent stream and a first residue stream; and supplying the first residue stream to a coker to produce coker vapors and solid coke, wherein the hydrocarbon feedstock further comprises nitrogen containing compounds, such that the step of contacting the hydrocarbon feedstock with the oxidant in the presence the catalyst oxidizes at least a portion of the nitrogen containing compounds, and wherein the residue stream supplied to the coker includes the oxidized nitrogen containing compounds;

the method further comprising the steps of supplying the extracted hydrocarbon stream to a stripper to produce a second recovered non-acidic polar organic solvent stream and a stripped hydrocarbon stream; and recycling the first recovered non-acidic polar organic solvent stream and the second non-acidic polar organic solvent stream to an extraction vessel for the step of separating the hydrocarbon stream into the extracted hydrocarbon stream and the mixed stream.

2. The method of claim 1, wherein the oxidant is selected from the group consisting of air, oxygen, oxides of nitrogen, peroxides, hydroperoxides, organic peracids, and combinations thereof.

3. The method of claim 1, wherein the oxidation reactor catalyst is a metal oxide having the formula $M_xO_y$, wherein M is an element selected from Groups IVB, VB, and VIB of the periodic table.

4. The method of claim 1, wherein the oxidation reactor is maintained at a temperature of between about 20 and 150° C. and at a pressure of between about 1-10 bars.

5. The method of claim 1, wherein the ratio of the oxidant to sulfur compounds present in the hydrocarbon feedstock is between about 4:1 and 10:1.

6. The method of claim 1, wherein the non-acidic polar organic solvent has a Hildebrandt value of greater than about 19.

7. The method of claim 1, wherein the solvent extraction is conducted at a temperature of between about 20° C. and 60° C. and at a pressure of between about 1-10 bars.

8. The method of claim 1, further comprising the step of supplying the extracted hydrocarbon stream to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized compounds.

9. The method of claim 8 further comprising supplying the second residue stream to coker.

10. The method of claim 8, wherein the adsorbent is selected from the group consisting of activated carbon, silica gel, alumina, natural clays, and combinations of the same.

11. The method of claim 8, wherein the adsorbent is a polymer coated support, wherein the support has a high surface area and is selected from the group consisting of silica gel, alumina, and activated carbon, and the polymer is selected from the group consisting of polysulfone, polyacrylonitrile, polystyrene, polyester terephthalate, polyurethane and combinations of the same.

12. A method for upgrading a hydrocarbon feedstock comprising sulfur containing compounds, the method for upgrading the hydrocarbon feedstock comprising the steps of:

supplying the hydrocarbon feedstock having a boiling point of up to about 500° C. to reaction zone where the hydrocarbon feedstock is contacted with an oxidant in the presence of a catalyst to oxidize at least a portion of the sulfur containing compounds in the hydrocarbon feedstock and produce an intermediate product stream comprising hydrocarbons and oxidized sulfur containing compounds;

supplying the intermediate product stream comprising hydrocarbons and oxidized sulfur containing compounds to an extraction vessel wherein the intermediate product stream is contacted with a non-acidic polar organic solvent, the non-acidic polar organic solvent being dimethylformamide, wherein said non-acidic polar organic solvent selectively extracts oxidized sulfur containing compounds from the intermediate product stream, to produce a first hydrocarbon product stream comprising hydrocarbons and having a lower concentration of sulfur containing compounds than the hydrocarbon feedstock and a mixed stream comprising the non-acidic polar organic solvent and the extracted oxidized sulfur containing compounds;

separating the mixed stream by distillation to produce a recovered non-acidic polar organic solvent stream comprising a major portion of the non-acidic polar organic solvent, and a residue stream comprising the oxidized sulfur containing compounds;

supplying the residue stream to a coker to produce a recovered hydrocarbon product stream comprising condensed coker vapors and gas oil and solid coke, wherein the coker includes a coker furnace and a coker drum, and wherein the coker furnace is operated at a temperature of at least about 400° C. and the coker drum is operated at a temperature of at least about 425° C. and a pressure in the range of between about 1 and 50 kg/cm$^2$; and recycling at least a portion of the recovered non-acidic polar organic solvent stream to the extraction vessel wherein at least a portion of the recovered non-acidic polar organic solvent stream is combined with the non-acidic polar organic solvent, wherein the hydrocarbon feedstock further comprises nitrogen containing compounds, such that the step of supplying the hydrocarbon feedstock to be contacted with the oxidant in the presence the catalyst oxidizes at least a portion of the nitrogen containing compounds, and wherein the residue stream supplied to the coker includes the oxidized nitrogen containing compounds.

13. The method of claim 12, wherein the step of oxidizing at least a portion of the sulfur containing compounds in the hydrocarbon feedstock comprises contacting the hydrocarbon feedstock with the oxidant and catalyst in the oxidation reaction, wherein the oxidation reactor is maintained at a temperature of between about 20° C. and 150° C. and a pressure of between about 1 and 20 bars for a contact time of between about 5 and 60 minutes.

14. The method of claim 13, wherein the ratio of catalyst to oil is between about 0.1% and 10% by weight.

15. The method of claim 12, wherein the non-acidic polar organic solvent has a Hildebrandt solubility value of greater than about 19.

16. The method of claim 13, wherein extraction vessel is maintained at a temperature of between about 20° C. and 60° C.

* * * * *